US008783234B2

(12) United States Patent
Araki

(10) Patent No.: US 8,783,234 B2
(45) Date of Patent: Jul. 22, 2014

(54) SUPERCHARGER MOUNTING TO AN ENGINE UNIT OF A VEHICLE

(75) Inventor: Toshio Araki, Kakogawa (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 1020 days.

(21) Appl. No.: 12/240,788

(22) Filed: Sep. 29, 2008

(65) Prior Publication Data

US 2010/0077997 A1 Apr. 1, 2010

(51) Int. Cl.
*F02B 33/00* (2006.01)
*F02B 33/40* (2006.01)
*F02B 29/04* (2006.01)

(52) U.S. Cl.
CPC ..... *F02B 33/40* (2013.01); *F02B 29/0475* (2013.01); *F02B 29/045* (2013.01)
USPC ..... 123/563; 123/559.1

(58) Field of Classification Search
CPC ..... F02B 29/0475; F02B 29/045
USPC ..... 123/198, 198 C, 559.1, 563; 440/88 A, 440/88 C
See application file for complete search history.

(56) References Cited

U.S. PATENT DOCUMENTS

| | | | | |
|---|---|---|---|---|
| 5,261,356 | A * | 11/1993 | Takahashi et al. | 123/563 |
| 7,654,876 | B1 * | 2/2010 | Jones et al. | 440/88 A |
| 2005/0016509 | A1 * | 1/2005 | Martin | 123/559.1 |
| 2005/0263127 | A1 * | 12/2005 | Pigott et al. | 123/198 R |
| 2006/0157036 | A1 * | 7/2006 | Andersen | 123/559.1 |
| 2007/0062498 | A1 * | 3/2007 | Woods | 123/559.1 |
| 2007/0215124 | A1 | 9/2007 | Ozaki et al. | |
| 2010/0071676 | A1 * | 3/2010 | Arvan | 123/559.1 |

FOREIGN PATENT DOCUMENTS

JP 2007-247518 9/2007

* cited by examiner

*Primary Examiner* — Mary A Davis
(74) *Attorney, Agent, or Firm* — Alleman Hall McCoy Russell & Tuttle LLP

(57) ABSTRACT

An engine unit includes an engine body, and a supercharging machine having a main body. The main body of the supercharging machine is coupled to the engine body via a component or a member disposed therebetween.

6 Claims, 7 Drawing Sheets

SUPERCHARGER MOUNTING TO AN ENGINE UNIT OF A VEHICLE

TECHNICAL FIELD

The present invention relates to an engine unit comprising a supercharging machine, and a vehicle comprising the engine unit.

BACKGROUND ART

As disclosed in Japanese Laid-Open Patent Application Publication No. 2007-247518, an engine unit mounted in a vehicle such as personal watercraft sometimes includes a supercharging machine such as a mechanical supercharger or a turbo charger (exhaust turbine supercharger).

Typically, a main body of the supercharging machine is directly mounted to a side surface of an engine body. In such a construction, since a vibration of the engine is directly transmitted to the main body of the supercharging machine, it is necessary to increase stiffness of the main body of the supercharging machine and resistance of components within the main body to the vibration.

During running of the engine, typically, a temperature of the main body of the supercharging machine tends to be higher than a temperature of the engine body, and therefore, the main body of the supercharging machine tends to be thermally deformed and expanded in an amount larger than the engine body due to a difference in expansion coefficients between the main body of the supercharging machine and the engine body. In order to avoid that the thermal deformation of the main body of the supercharging machine and the thermal deformation of the engine body affect each other, it becomes necessary to increase rigidness of the main body of the supercharging machine and the engine body, for example. Furthermore, since the heat tends to be transferred from the main body of the supercharging machine to the engine body, it is difficult to cool the engine body.

SUMMARY OF THE INVENTION

The present invention addresses the above described conditions, and an object of the present invention is to reduce a vibration of a main body of a supercharging machine, to prevent a thermal deformation of the main body of the supercharging machine and a thermal deformation of an engine body from affecting each other, and to facilitate cooling of an engine.

According to a first aspect of the present invention, there is provided an engine unit comprising an engine body, and a supercharging machine having a main body, wherein the main body of the supercharging machine is coupled to the engine body via a component or a member disposed therebetween.

In accordance with such a configuration, since the vibration of the engine is absorbed by the component or the member disposed between the main body of the supercharging machine and the engine body, it is less likely to be transmitted to the supercharging machine. In addition, thermal deformation of the main body of the supercharging machine is absorbed by the component or the member. Furthermore, since the heat of the main body of the supercharging machine is not directly transmitted to the engine body, cooling of the engine body is facilitated.

According to another aspect of the present invention, there is provided an engine unit comprising an engine body; and a supercharging machine having a main body; a passage member forming an air passage through which air flows to the supercharging machine or through which the air discharged from the supercharging machine flows; wherein the passage member is disposed between the engine body and the main body of the supercharging machine.

In accordance with such a configuration, since the heat of the main body of the supercharging machine is blocked by the passage member and is less likely to be transmitted to the engine body, cooling of the engine is facilitated.

The above described engine unit may be applied to various vehicles such as motorcycles, off-road vehicles, or personal watercraft.

The above and further objects and features of the invention will more fully be apparent from the following detailed description with accompanying drawings.

DETAILED DESCRIPTION OF THE PREFERRED EMBODIMENTS

Hereinafter, embodiments of the present invention will be described with reference to the accompanying drawings. Hereinbelow, the directions are referenced from a perspective of a rider riding in a personal watercraft except for cases otherwise specifically illustrated.

(Embodiment 1)

Figure 1:
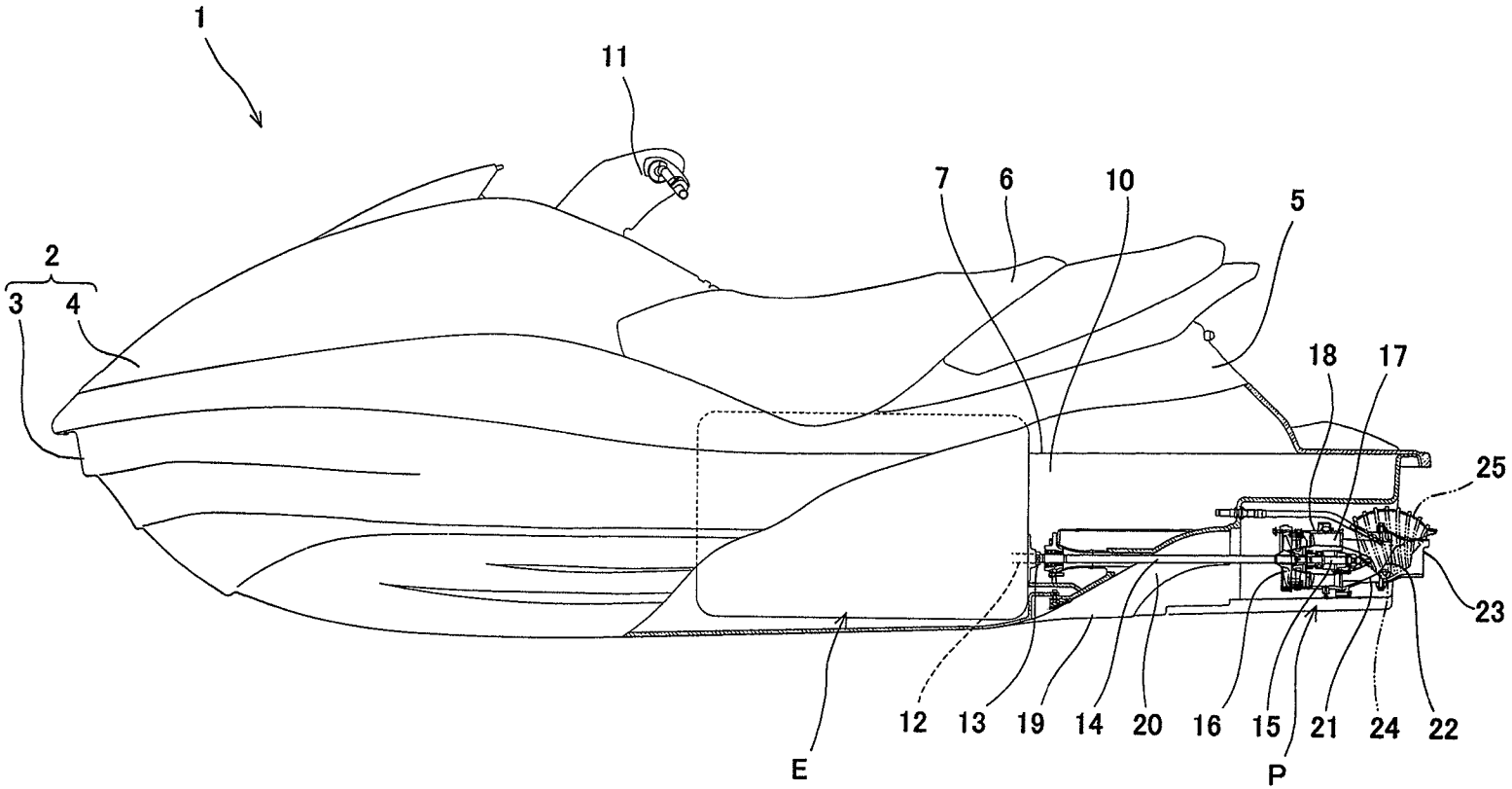
FIG. 1 is a cross-sectional view of a personal watercraft according to an embodiment of the present invention, a part of which is cut away, as viewed from the left.

FIG. 1 is a cross-sectional view of a personal watercraft 1 according to the embodiment of the present invention, a part of which is cut away, as viewed from the left. Turning now to FIG. 1, the personal watercraft 1 of FIG. 1 is a straddle-type jet-propulsion personal watercraft which is provided with a seat 6 straddled by the rider. A body 2 of the watercraft 1 includes a hull 3 and a deck 4 covering the hull 3 from above. A center section in a width direction protrudes upward at a rear part of the deck 4 to form a protruding portion 5. The seat 6 is mounted over an upper surface of the protruding portion 5. A deck floor 7 is formed at both sides in the width direction of the protruding portion 5 to be substantially flat and lower than the protruding portion 5 to enable the rider to put feet thereon.

A space defined by the hull 3 and the deck 4 below the seat 6 is an engine room 10 in which an engine unit E is mounted. A crankshaft 12 of the engine unit E extends along the longitudinal direction of the body 2. An output end portion of the crankshaft 12 is coupled to a propeller shaft 14 via a coupling device 13. The propeller shaft 14 is coupled to a pump shaft 15 of a water jet pump P disposed at a rear portion of the body 2.

The propeller shaft 14 and the pump shaft 15 rotate in association with the rotation of the crankshaft 12. An impeller 16 is attached on the pump shaft 15 of the water jet pump P. Fairing vanes 17 are disposed behind the impeller 16. The impeller 16 is covered with a tubular pump casing 18 on the outer periphery thereof.

A water intake 19 is provided on a bottom surface of the hull 3 of the body 2. The water intake 19 is connected to the pump casing 18 through a water passage 20. A pump nozzle 21 is disposed at a rear portion of the body 2 and coupled to the pump casing 18. The pump nozzle 21 has a diameter decreasing rearward, and an outlet port 22 opens at a rear end thereof. A steering nozzle 23 is coupled to the pump nozzle 21 to extend rearward in the vicinity of the outlet port 22 such that the steering nozzle 23 is pivotable to the right or to the left.

Water outside the watercraft 1 is sucked from the water intake 19 on the bottom surface of the hull 3 and is fed to the water jet pump P through the water passage 20. Driven by the engine unit E, the water jet pump P causes the impeller 16 to rotate to pressurize and accelerate the water. The water is guided by the fairing vanes 17 and ejected rearward from the outlet port 22 of the pump nozzle 21 and through the steering nozzle 23. As the resulting reaction, the watercraft 1 obtains a propulsion force for propelling the body 2. A bowl-shaped reverse deflector 25 is mounted at an upper portion of the steering nozzle 23 to be pivotable around a pivot shaft 24 oriented substantially horizontally.

A bar-type steering handle 11 is disposed in front of the seat 6. A throttle lever (not shown) is attached to a right grip of the handle 11 and is configured to be operated with a right hand of the rider. The handle 11 is coupled to the steering nozzle 23 via a steering cable (not shown). When the rider rotates the steering handle 11 clockwise or counterclockwise, the steering nozzle 23 is pivotable to the right or to the left, changing the direction of the water ejected from the steering nozzle 23 to the left or to the right. Correspondingly, the moving direction of the watercraft 1 can be changed.

Figure 2:
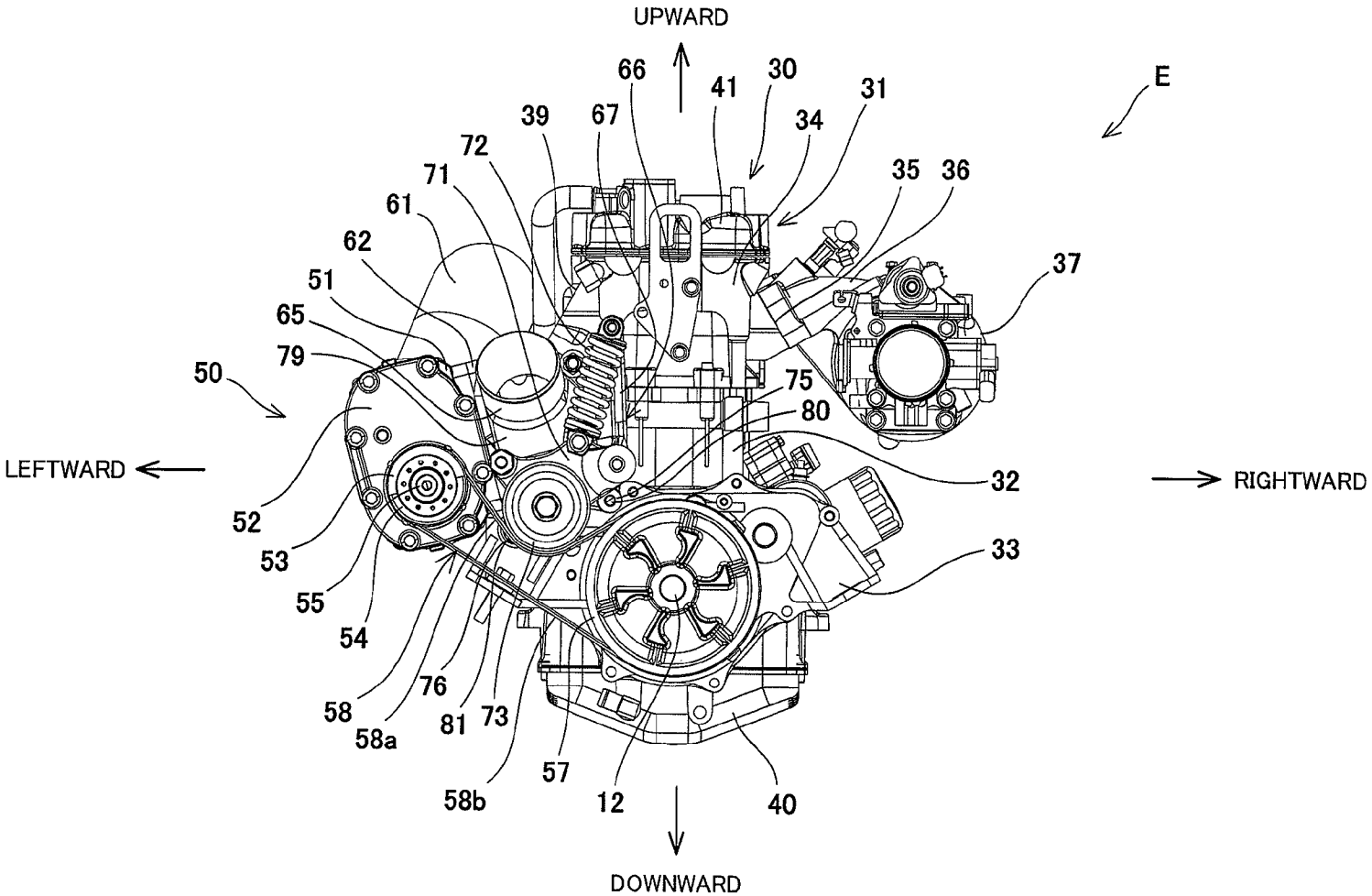
FIG. 2 is a rear view of an engine unit according to a first embodiment of the present invention.
Figure 3:
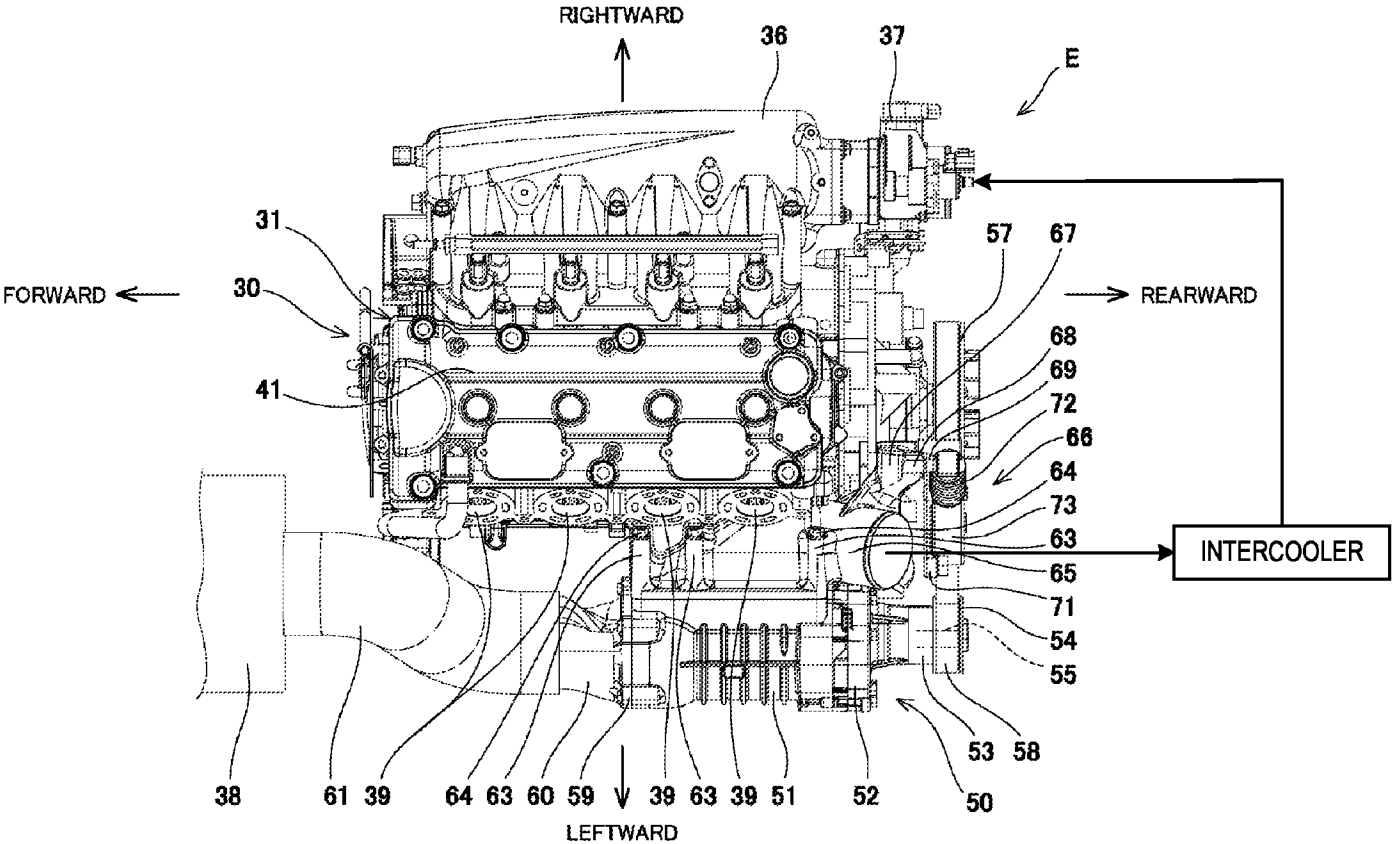
FIG. 3 is a plan view of the engine unit according to the first embodiment of the present invention.
Figure 4:
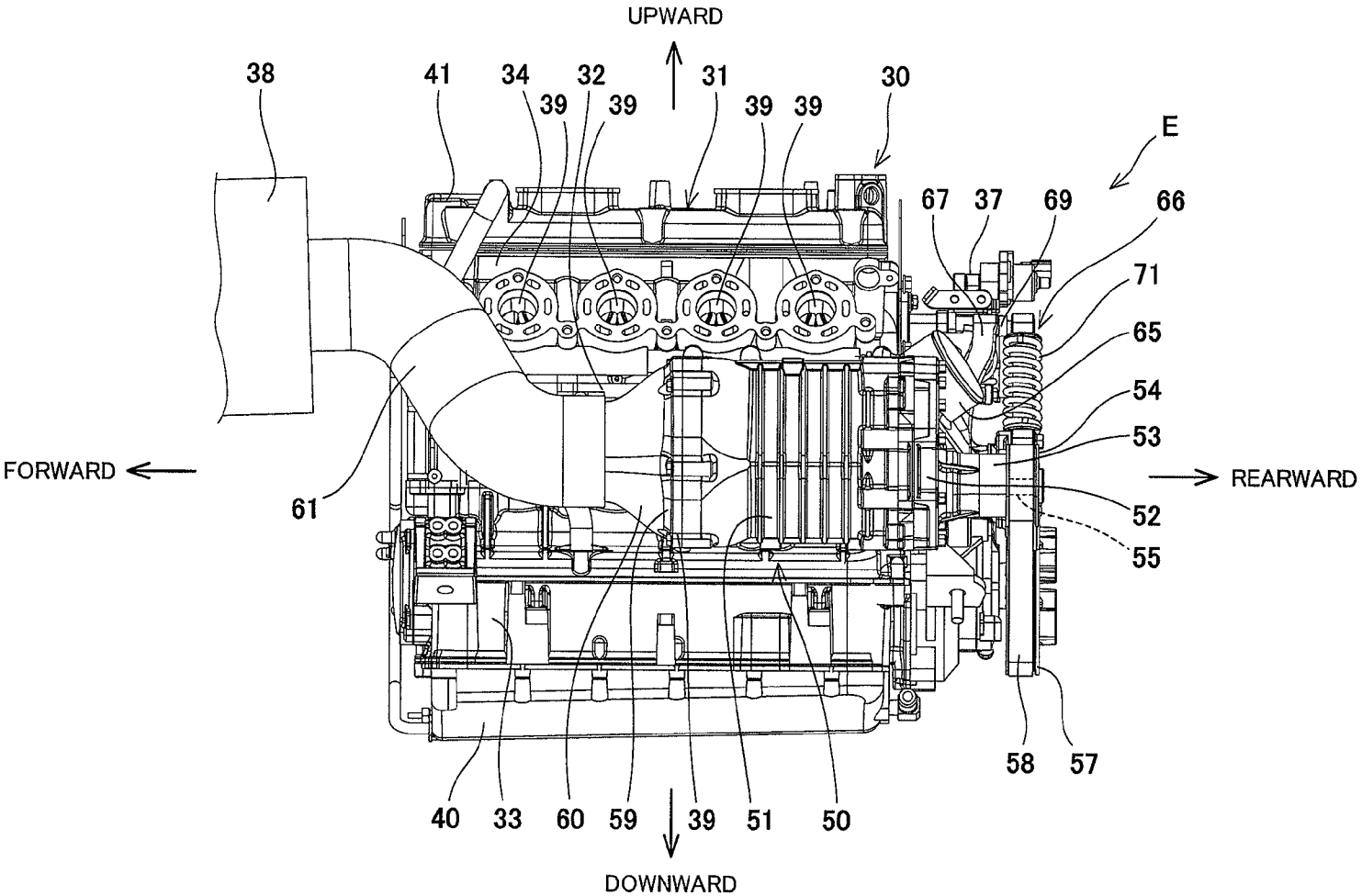
FIG. 4 is a left side view of the engine unit according to the first embodiment of the present invention.

FIG. 2 is a rear view of an engine unit E according to a first embodiment of the present invention. FIG. 3 is a plan view of the engine unit E. FIG. 4 is a left side view of the engine unit E. The engine unit E shown in FIGS. 2 to 4 includes a reciprocating multi-cylinder four-cycle engine (hereinafter simply referred to as an engine) 30 and a supercharging machine 50.

Turning now to FIGS. 2 to 4, the engine 30 is an inline four-cylinder engine, including four cylinders (not shown) arranged in the longitudinal direction of the body 2. A piston (not shown) is inserted into each cylinder. The number and arrangement of cylinders may be suitably changed.

As shown in FIG. 2, an engine body 31 of the engine 30 includes a cylinder block 32 in which the cylinders are formed, a crankcase 33 coupled to a lower portion of the cylinder block 32, a cylinder head 34 coupled to an upper portion of the cylinder block 32. In the cylinder head 34, a plurality of combustion chambers (not shown) are formed to respectively correspond to the cylinders. The crankshaft 12, which is an output shaft of the engine 30, is rotatably mounted to the crankcase 33.

Air-intake ports 35 are formed to open on a right side surface of the cylinder head 34 and are respectively connected to the associated combustion chambers. Each intake port 35 forms a part of an intake passage connected to the engine 30, through which air taken in from outside is supplied to the engine 30. An air-intake manifold 36 is coupled to the intake port 35. As shown in FIG. 3, the air-intake manifold 36 extends on the right side above the engine body 31 in the longitudinal direction of the engine body 31. A throttle body 37 is coupled to a rear end portion of the air-intake manifold 36. A throttle valve (not shown) is provided within the throttle body 37 and is configured to change an opening degree of the air-intake passage according to an amount of operation of the throttle lever (not shown). An upstream portion of the throttle body 37 communicates with outside the watercraft 1 via the supercharging machine 50, an air box 38, the engine room (FIG. 1) 10, and the interior of the watercraft 1.

As shown in FIG. 2, exhaust ports 39 are formed to open on a left side surface of the cylinder head 34, and are respectively connected to the associated combustion chambers. Each exhaust port 39 forms a part of an exhaust passage through which an exhaust gas is discharged outside the watercraft 1. The exhaust ports 39 are arranged in the longitudinal direction of the body 2. An exhaust manifold (not shown) is coupled to a left side surface of the cylinder head 34 and is connected to the exhaust ports 39. The exhaust manifold communicates with outside the watercraft 1 via an exhaust pipe (not shown) extending on the left side above the engine body 31 in the longitudinal direction and muffler components (not shown) coupled to a rear end of the exhaust pipe.

As shown in FIGS. 2 and 4, an oil pan 40 is coupled to a lower portion of the crankcase 33 and is configured to store engine oil, and a cylinder head cover 41 is coupled to an upper portion of the cylinder head 34.

As shown in FIGS. 2 and 3, the supercharging machine 50 includes a box-like supercharging machine main body (hereinafter referred to as a main body) 51. In the present embodiment, a mechanical supercharger is illustrated as the supercharging machine 50, but a turbo charger such as an exhaust turbine supercharger may be used as the supercharging machine 50. In cases where the turbo charger is used, pulleys 54 and 57, a belt 58, and a tension unit 66 may be omitted and passage members to connect the exhaust manifold (not shown) to the main body 51 of the supercharging machine 50 may be provided as required.

The main body 51 of the supercharging machine 50 is disposed on the left side of the engine body 31. The main body 51 opens at front and rear surfaces thereof. A rear cover 52 is coupled to cover the rear surface of the main body 51. A cylindrical portion 53 is provided at a lower portion of an outer surface of the rear cover 52 to protrude rearward. A driven pulley 54 is rotatably mounted to an end portion of the cylindrical portion 53. A drive shaft 55 is attached to a center of the driven pulley 54. The drive shaft 55 extends in the interior of the cylindrical portion 53 and the interior of the main body 51 in the longitudinal direction. A compressor (not shown) is built into the main body 51 and is configured to operate in association with the rotation of the drive shaft 55.

Turning to FIG. 2, a drive pulley 57 is attached to the rear end portion, i.e., the output end portion of the crankshaft 12. An endless belt 58 is installed around the drive pulley 57 and the driven pulley 54. In this construction, the rotation of the crankshaft 12 is transmitted to the driven pulley 54 via the belt 58, causing the driven pulley 54 to rotate integrally with the drive shaft 55. Thus, a driving power generated in the engine 30 causes the drive shaft 55 to rotate, causing the compressor to supercharge intake-air.

The mechanism for transmitting the rotation of the crankshaft 12 of the engine 30 to the drive shaft 55 of the supercharging machine 50 is not limited to the above described mechanism including the belt 58, and the pulleys 54 and 57, but may be comprised of sprockets which replace the pulleys 54 and 57 and a chain which is an endless transmission member installed around the sprockets, or otherwise gears.

When the gears are used to transmit the rotation of the crankshaft 12 to the drive shaft 55, a tensioner unit 66 may be omitted.

As shown in FIGS. 3 and 4, a front cover 59 is coupled to cover a front surface of the main body 51. The front cover 59 has a funnel portion 60 protruding forward in a funnel shape from an outer surface thereof. The funnel portion 60 has a circular opening at a front end thereof. An intake duct 61 is coupled to the front end of the funnel portion 60. The intake duct 61 extends substantially in the longitudinal direction. The interior of the main body 51 communicates with the air box 38 via the interior of the funnel portion 60 and the intake duct 61. The air box 38 has a labyrinth structure in the interior thereof to trap moisture, etc., while the air taken in from outside is flowing through the interior of the air box 38. The air box 38 is, for example, disposed in front of the engine body 31.

Passage members 59, 60, and 61 are coupled to a front portion of the main body 51 to form an air passage through which the air is guided to the main body 51. The supercharging machine 50 is configured to compress the air delivered from the air box 38 to the main body 51 through the passage members 59, 60, and 61, and supplies the compressed high-temperature and high-pressure air to the cylinder (combustion chamber) of the engine body 31 via an air outlet (not shown) formed on the main body 51. In present embodiment, the air outlet is formed on a right side surface of the main body 51 which is opposite to the engine body 31.

Figure 5:
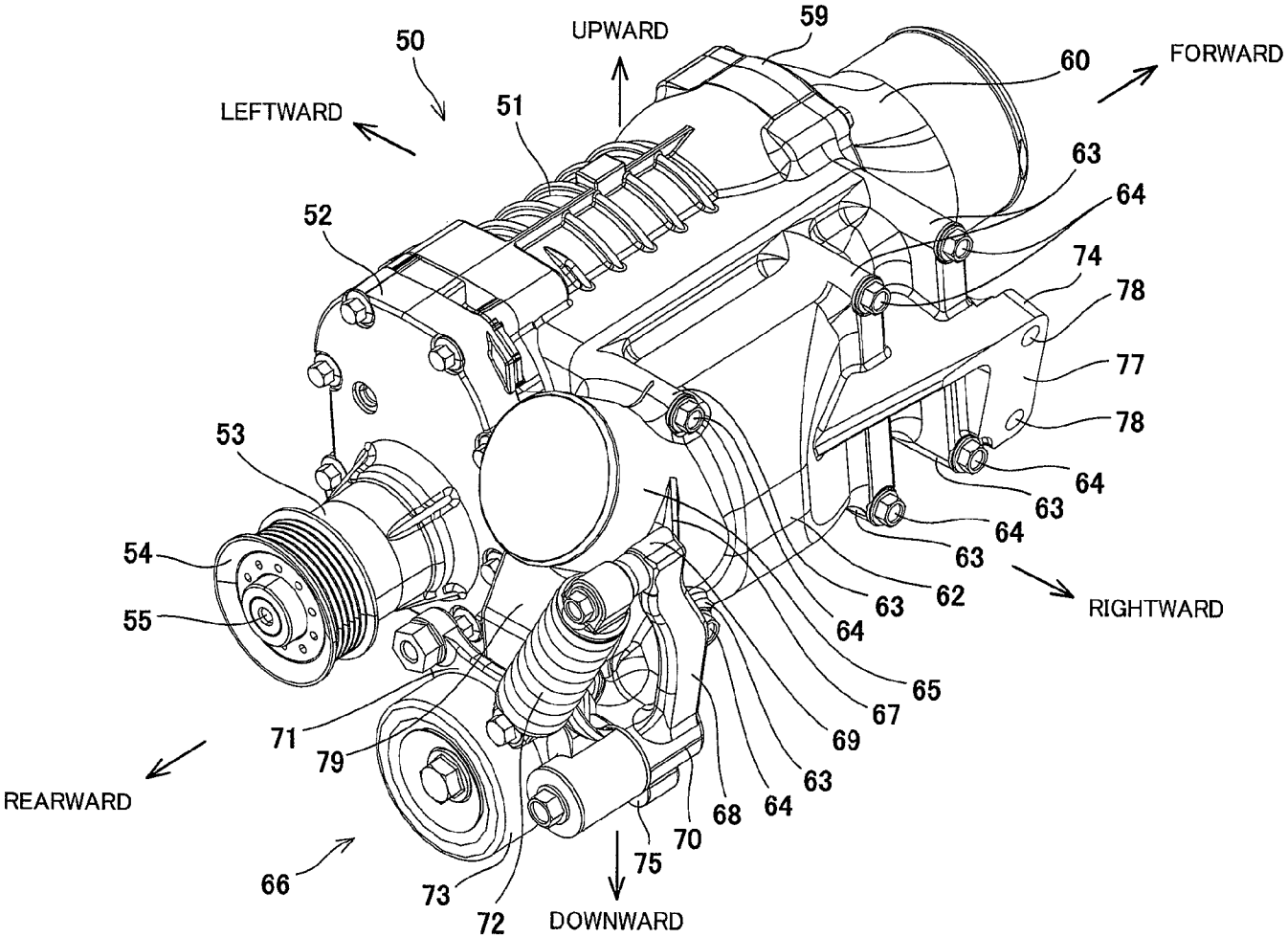
FIG. 5 is a perspective view of a supercharging machine of the engine unit according to the first embodiment of the present invention.

FIG. 5 is a perspective view of the supercharging machine 50 of the engine unit E according to the first embodiment of the present invention. As shown in FIG. 5, the side cover 62 is coupled to the right side surface of the main body 51. The side cover 62 is sized so as to cover the entire right side surface of the main body 51 in the vertical direction and in the longitudinal direction.

A plurality of nut members 63 are formed integrally with an upper end portion and a lower end portion of the side cover 62 and are arranged forward and rearward, i.e., in the longitudinal direction of the side cover 62. Bolts 64 are inserted into the nut portions 63 from the right to fasten the side cover 62 to the main body 51.

The cylindrical portion 65 protrudes from a rear end surface of the side cover 62 and extends upward in a rearward direction. A discharge duct (not shown) is coupled to the cylindrical portion 65. Thus, passage members forming an air passage through which the air from the main body 51 flows are coupled to the right side of the main body 51. The side cover 62 forms one of the passage members. The high-temperature and high-pressure air resulting from the compression in the compressor of the supercharging machine 50 is delivered to the interior of the side cover 62 via the air outlet (not shown) formed on the main body 51, and then to the discharge duct through the interior of the cylindrical portion 65. The discharge duct extends rearward with respect to the supercharging machine 50 and is coupled to an intercooler (not shown). The high-pressure air, which has been cooled by the intercooler, is delivered to the interior of the throttle body 37 via a duct (not shown) coupled to the intercooler and is supplied to the cylinder (combustion chamber) of the engine body 31.

A tensioner unit 66 is attached to the side cover 62 to make tense the endless belt 58 (see FIG. 2) through which the engine driving power is transmitted to the supercharging machine 50, which is the mechanical supercharger. To be specific, a bracket member 67 is provided integrally on the cylindrical portion 65 of the side cover 62 so as to protrude rightward and forward from a right portion of an outer peripheral surface of the cylindrical portion 65. An extending portion 68 is provided integrally with the bracket member 67 to extend downward from a rear end thereof. Upper and lower boss portions 69 and 70 are provided at an upper end portion and a lower end portion of the extending portion 68, respectively such that their axes are oriented forward and rearward. The tensioner bracket 71 is coupled to the lower boss portion 70 to be pivotable around a center axis of the lower boss portion 70. The tensioner bracket 71 is flat-plate shaped and extends on the left side of the lower boss portion 70.

A tensioner damper 72 is provided to extend between the upper boss portion 69 and the upper portion of the tensioner bracket 71. The tensioner damper 72 includes a hydraulic damper disposed to extend along an axis thereof and a coil spring mounted to the outer periphery of the hydraulic damper. The tensioner damper 72 is tilted leftward in a downward direction. A pressing force corresponding to an elastic force of the coil spring is applied to the tensioner bracket 71 in a counterclockwise direction in a rear view.

A tensioner pulley 73 is rotatably attached to a lower end portion of the tensioner bracket 71. The tensioner pulley 73 is disposed between the drive pulley 57 and the driven pulley 54, and is disposed at the same position in the longitudinal direction of the body 2 as the drive pulley 57 and the driven pulley 54.

As shown in FIG. 2, the belt 58 has an upper belt line **58*a* and a lower belt line 58*b* which are installed around the drive pulley 57 and the driven pulley 54. The upper belt line 58*a* extends on the upper side in a relatively loose state. The tensioner pulley 73 is in contact with the outer surface of the upper belt line 58*a*. The tensioner damper 72 applies a force to the tensioner pulley 73 and the tensioner bracket 71. Under the force applied from the tensioner damper 72, the tensioner pulley 73 presses the upper belt line 58*a* substantially downward to make the upper belt line 58*a* tense so that the belt 58** does not get loose.

As described above, the tensioner unit 66 is attached to the side cover 62 to make the belt 58 tense. Since the tensioner unit 66 is directly attached to the component of the supercharging machine 50, it is easily positioned as desired. To be specific, the tensioner damper 72 is easily positioned with respect to the driven pulley 54 with a correct angle and displacement of the tensioner pulley 73 with respect to the belt 58 in the longitudinal direction, the horizontal direction, and the vertical direction is less likely to occur. This makes it possible that the tensioner damper 72 applies a desired force to the tensioner bracket 71 and the belt 58 is made tense based on the force applied to the tensioner pulley 73. As described later, since the side cover 62 is directly coupled to the engine body 31, the tensioner damper 72 and the tensioner pulley 73 can be positioned without displacement with respect to the drive pulley 57.

As shown in FIG. 5, an end portion of the extending portion 68 is positioned rearward relative to a rear end portion of the cylindrical portion 65. The tensioner bracket 71 is attached to a lower end portion of the extending portion 68, while the cylindrical portion 65 extends obliquely upward. So, the tensioner bracket 71 is disposed below and behind the cylindrical portion 65. Therefore, the tensioner unit 66 is attached to the side cover 62 without interfering with the cylindrical portion 65 and the discharge duct (not shown) coupled to the cylindrical portion 65.

In a case where a chain is used as an endless driving power transmission member instead of the belt, a tensioner unit for making the chain tense may be provided. In this case, the tensioner unit is attached to the side cover 62 which is disposed between the main body 51 of the supercharging machine 50 and the engine body 31 to couple the main body 51 of the supercharging machine 50 to the engine body 31.

First, second and third mounting members 74, 75, and 76 are provided at the side cover 62 to mount the supercharging machine 50 to the engine body 31.

As shown in FIG. 5, the first mounting member 74 protruding rightward is provided at a right side of a front end portion of the side cover 62. A protruding end surface 77 of the first mounting member 74 is tilted to conform in shape to a left side surface of the engine body 31, to be specific, a left side surface of the cylinder block 32. A plurality of through holes 78 are formed to open on the protruding end surface 77 of the first mounting member 74 such that they are disposed in upper and lower positions.

An extending portion 79 is provided integrally with the cylindrical portion 65 formed at the rear end portion of the side cover 62 so as to extend downward from a lower portion of an outer peripheral surface thereof. The second mounting member 75 (see FIG. 2), which is cylindrical, is provided at a right end portion of the extending portion 79, while the third mounting member 76, which is cylindrical, is provided at a left end portion of the extending portion 79. The second and third mounting members 75 and 76 are provided with through holes 80 and 81, respectively, penetrating therethrough in the longitudinal direction of the body 2.

When the supercharging machine 50 is mounted to the engine body 31, the protruding end surface 77 of the first mounting member 74 of FIG. 5 is brought into contact with the left side surface of the engine body 31 (see FIG. 3), and bolts (not shown) are inserted into the through holes 78, respectively, from the left. The side cover 62 is fastened to the left side surface of the engine body 31 by the bolts as shown in FIG. 3. Then, the front end surface of the second mounting member 75 of FIG. 2 and the front end surface of the third mounting member 76 of FIG. 2 are brought into contact with the rear surface of the crankcase 33 and bolts (not shown) are inserted into the through holes 80 and 81 from behind. The side cover 62 is fastened to the rear surface of the engine body 31 by the bolts.

The first mounting member 74 is spaced apart from the second and third mounting members 75 and 76, in the forward and rearward direction, i.e., in the longitudinal direction of the side cover 62. For this reason, the side cover 62 and the main body 51 of the supercharging machine 50 are stably fastened to the engine body 31.

Since the main body 51 of the supercharging machine 50 is coupled to the engine body 31 via the side cover 62, the vibration of the engine body 31 generated due to the reciprocation of the piston (not shown), or the like, during running of the engine 30, is transmitted to the side cover 62 and then to the main body 51. Since the vibration of the engine body 31 is absorbed by the side cover 62, the vibration of the engine 30 is less likely to be transmitted to the main body 51 of the supercharging machine 50, in contrast to a case where the main body 51 is directly mounted to the engine body 31. For this reason, the stiffness of the main body 51 of the supercharging machine 50 need not be increased significantly, or vibration resistance of the mounting structure of the drive shaft 55 or the components of the compressor within the main body 51 need not be increased significantly. As a result, the supercharging machine 50 can be manufactured at a low cost.

During running of the engine 30, the temperature of the main body 51 of the supercharging machine 50 tends to be higher than the temperature of the engine body 31, and therefore the main body 51 may be thermally expanded in larger amount than the engine body 31. However, in the present embodiment, since the difference in coefficients of thermal expansion between the engine body 31 and the main body 51 is absorbed by the side cover 62 disposed between the main body 51 and the engine body 31, the thermal deformation of main body 51 and the thermal deformation of the engine body 31 do not affect each other.

Since the side cover 62 is disposed between the main body 51 and the engine body 31, heat generated in the vicinity of the compressor which is disposed in the interior of the main body 51 of the supercharging machine 50 is less likely to be transmitted to the engine body 31. Since the engine 30 is not substantially subjected to the heat from the supercharging machine 50 in this way, the temperature of the engine body 31 is easily controlled at a suitable one, enabling the engine 30 to run efficiently. In the present embodiment, since the main body 51 of the supercharging machine 50 is not directly coupled to the engine body 31, the heat generated in the main body 51 is less likely to be transmitted to the engine body 31.

(Embodiment 2)

Figure 6:
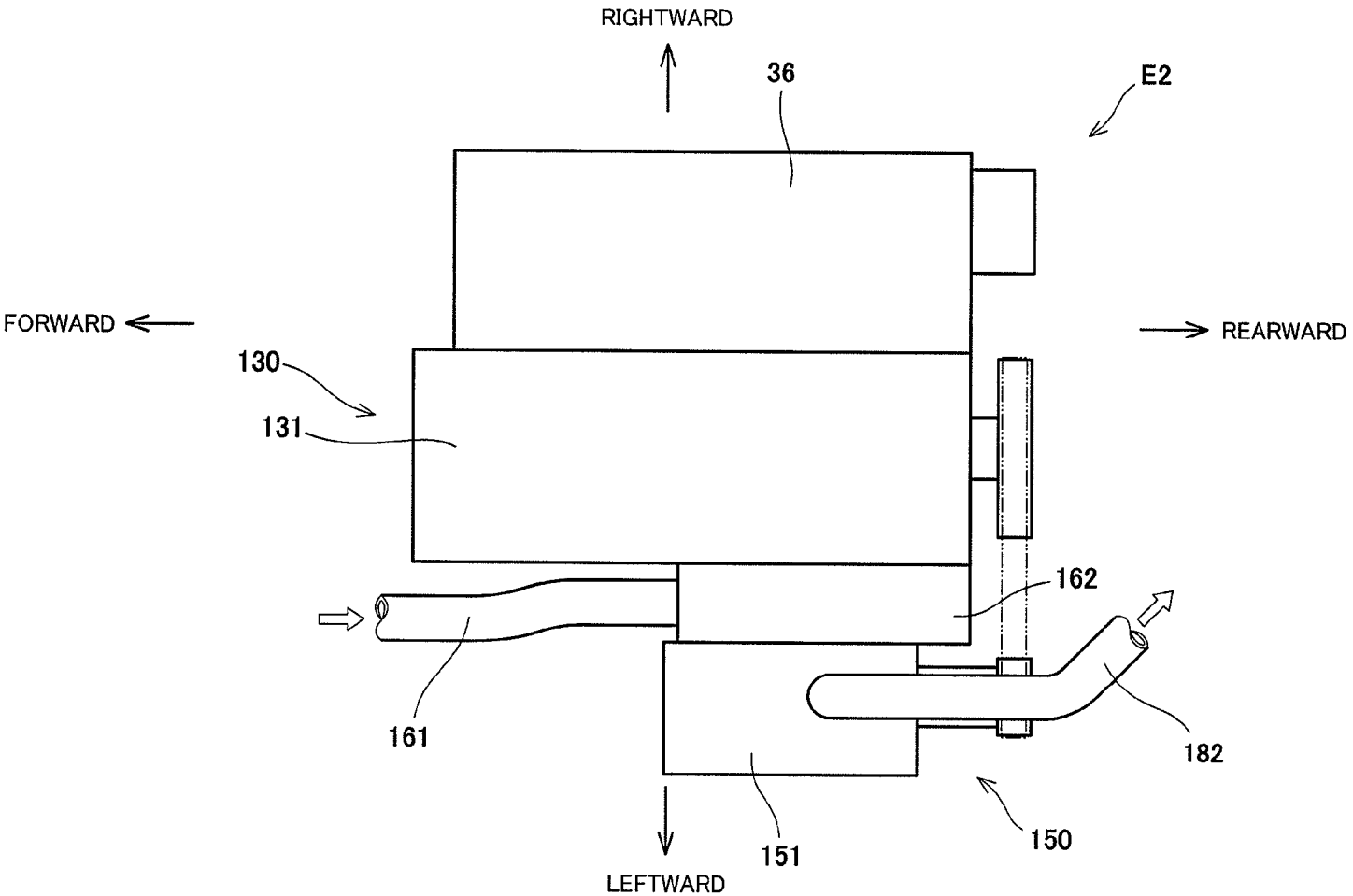
FIG. 6 is a plan view showing a schematic configuration of an engine unit according to a second embodiment of the present invention.

FIG. 6 is a plan view showing a schematic configuration of an engine unit E2 according to a second embodiment of the present invention. As shown in FIG. 6, the engine unit E2 includes an engine 130 and a supercharging machine 150. A main body 151 of the supercharging machine 150 is disposed on the left side of an engine body 131 of the engine 130.

A side cover 162 is coupled to a right side surface of the main body 151. An intake duct 161 extends forward from a front surface of the side cover 162. The intake duct 161 is coupled to an air box which is not shown. In this construction, the air from the air box is delivered to the interior of the main body 151 of the supercharging machine 150 via the intake duct 161 and the interior of the side cover 162. Thus, the side cover 162 forms a part of passage members forming an air passage through which the air flows to the supercharging machine 150.

A discharge duct 182 is coupled to an upper surface of the main body 151. The discharge duct 182 extends rearward with respect to the main body 151 and is coupled to the intercooler (not shown). In this construction, the air, which has been compressed within the main body 151, is delivered to the intercooler via the discharge duct 182.

The side cover 162 is fastened to a left side surface of the engine body 131. So, the main body 151 is coupled to the engine body 131 via the side cover 162. Also, the side cover 162 is disposed between the main body 151 and the engine body 131. Furthermore, a tensioner unit (not shown) is attached to the side cover 162 as in the first embodiment.

In this construction, advantages similar to those of the first embodiment are achieved. The component or the member coupling the main body of the supercharging machine to the engine body and/or the component or the member disposed between the engine body and the main body of the supercharging machine are/is not limited to the component or the member forming the air passage through which the air discharged from the supercharging machine flows, as described in the first embodiment, but may be the component or the member forming the air passage through which the air flows to the supercharging machine as described in the second embodiment.

(Embodiment 3)

Figure 7:
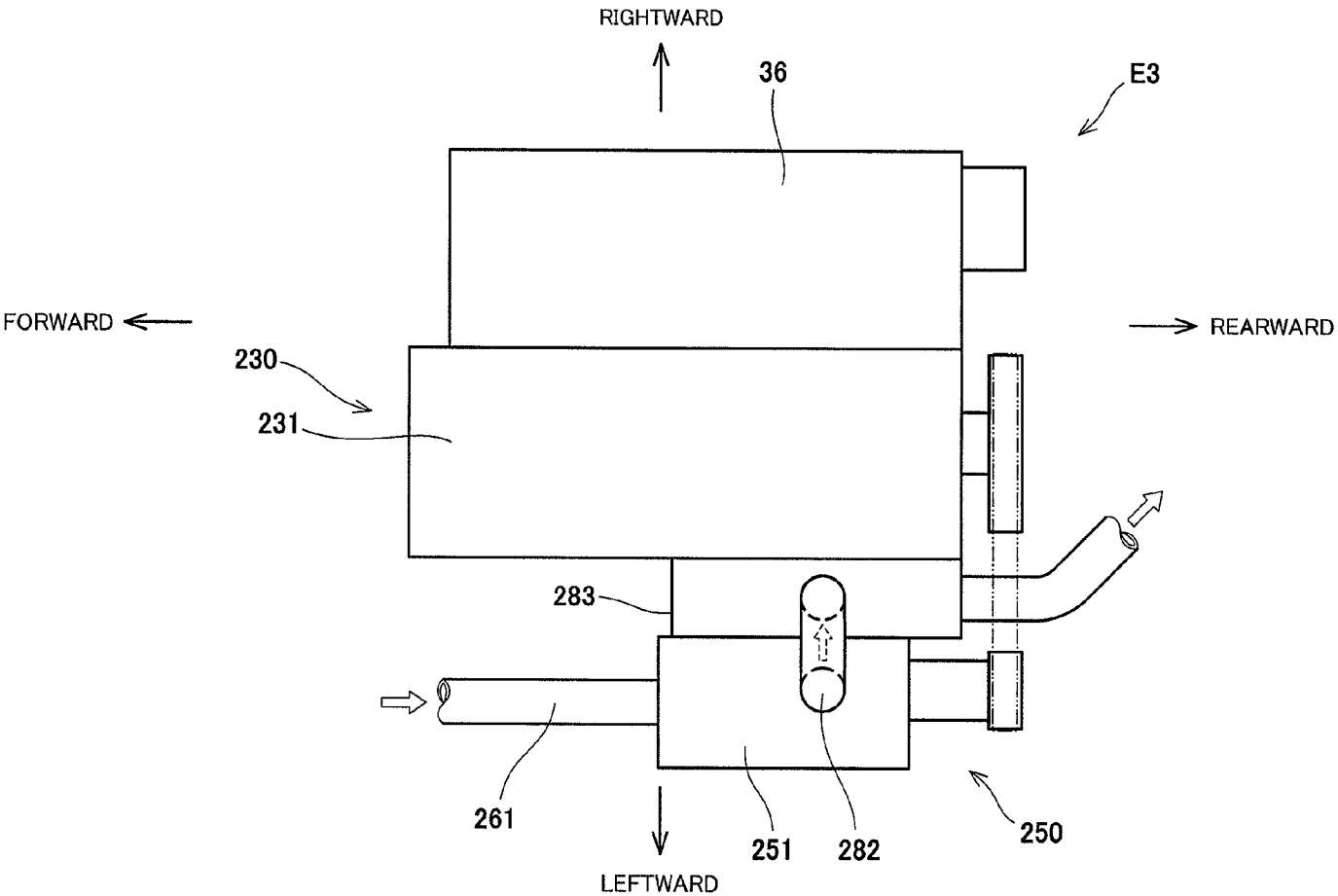
FIG. 7 is a plan view showing a schematic configuration of an engine unit according to a third embodiment of the present invention.

FIG. 7 is a plan view showing a schematic configuration of an engine unit E3 according to a third embodiment of the present invention. As shown in FIG. 7, the engine unit E3 includes an engine 230 and a supercharging machine 250. A main body 251 of the supercharging machine 250 is disposed on the left side of an engine body 231 of the engine 230.

An intake duct 261 extends forward from a front surface of the main body 251 of the supercharging machine 250. The intake duct 261 is coupled to the air box (not shown). In this construction, the air from the air box is delivered to the interior of the main body 251 via the intake duct 261. A discharge duct 282 is coupled to an upper surface of the main body 251. The discharge duct 282 extends to the right above the main body 251 and is coupled to an intercooler 283. Thereby, the air, which has been compressed within the main body 251, is delivered to the intercooler 283 via the discharge duct 282. A tensioner unit (not shown) is attached to a rear end surface of the intercooler 283, as in the first embodiment.

The intercooler 283 is disposed between the main body 251 and the engine body 231. The left side surface of the intercooler 283 is coupled to the main body 251 and the right side surface of the intercooler 283 is coupled to the left side surface of the engine body 231.

In this construction, also, advantages similar to those of the first embodiment are achieved. The component or the member coupling the main body of the supercharging machine to the engine body and/or the component or the member disposed between the engine body and the main body of the supercharging machine are/is not limited to the component or the member forming the air passage through which the air flows to the supercharging machine, through which the air discharged from the supercharging machine flows, as in the first and second embodiments.

Whereas in the above described embodiments, the main body of the supercharging machine is disposed on the left side of the engine body, it may be disposed in another position with respect to the engine, so long as the main body of the supercharging machine is coupled to the engine body via the component or the member and the component or the member is disposed between the main body of the supercharging machine and the engine body.

The engine unit of the present invention is suitably applicable to other vehicles such as motorcycles and off-road vehicles, as well as the personal watercraft described in the embodiments.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An engine unit comprising:

an engine body;

a supercharging machine having a main body; and an intercooler;

wherein the main body of the supercharging machine is spaced apart from the engine body, wherein the main body of the supercharging machine is coupled to the engine body via a side cover that is sandwiched between the engine body and the main body of the supercharging machine, wherein the side cover forms an air passage through which air flows from the supercharging machine to the intercooler, wherein the side cover is fastened to the main body of the supercharging machine so as to cover a side surface of the main body, the side surface being opposite to the engine body in a right and left direction, wherein the side cover is fastened to an outer surface of the engine body, wherein a cylindrical portion protrudes from a rear end surface of the side cover and a discharge duct is coupled to the cylindrical portion, and wherein the discharge duct extends rearward with respect to the supercharging machine and is coupled to the intercooler.

2. The engine unit according to claim 1, further comprising:

an endless transmission member through which an engine driving power is transmitted to a drive shaft of the supercharging machine; and a tensioner unit configured to make the transmission member tense;

wherein the tensioner unit is attached to the side cover.

3. The engine unit according to claim 2, wherein the tensioner unit includes a tensioner pulley which is configured to contact the transmission member and a tensioner damper configured to apply a pressing force to the tensioner pulley; and wherein the tensioner pulley and the tensioner damper are attached to the side cover.

4. The engine unit according to claim 1, further comprising:

an air-intake manifold which is coupled to an air-intake port of the engine body; and a throttle body which is coupled to the air-intake manifold, wherein the intercooler delivers air from the side cover to the throttle body, wherein an air outlet of the main body of the supercharging machine is formed on the side surface of the main body of the supercharging machine, and wherein the side cover is fastened to the supercharging machine so as to cover the air outlet.

5. A vehicle comprising:

an engine unit configured to generate an engine driving power for moving a body of the vehicle, wherein the engine unit includes an engine body, a supercharging machine having a main body, and an intercooler, wherein the main body of the supercharging machine is spaced apart from the engine body, wherein the main body of the supercharging machine is coupled to the engine body via a side cover that is sandwiched between the engine body and the main body of the supercharging machine, wherein the side cover forms an air passage through which air flows from the supercharging machine to the intercooler, wherein the side cover is fastened to the main body of the supercharging machine so as to cover a side surface of the main body, the side surface being opposite to the engine body in a right and left direction, wherein the side cover is fastened to an outer surface of the engine body;

wherein a cylindrical portion protrudes from a rear end surface of the side cover and a discharge duct is coupled to the cylindrical portion, and wherein the discharge duct extends rearward with respect to the supercharging machine and is coupled to the intercooler.

6. The vehicle according to claim 5, further comprising:

an air-intake manifold which is coupled to an air-intake port of the engine body; and a throttle body which is coupled to the air-intake manifold, wherein the intercooler delivers air from the side cover to the throttle body, wherein an air outlet of the main body of the supercharging machine is formed on the side surface of the main body of the supercharging machine, and wherein the side cover is fastened to the supercharging machine so as to over the air outlet.

* * * * *